United States Patent [19]

Ogura et al.

[11] 4,251,345

[45] Feb. 17, 1981

[54] METHOD FOR EFFECTING COAL-LIQUEFYING REACTION

[75] Inventors: Tsugitoshi Ogura, Isahaya; Akio Hiraki, Takadago; Hikokusu Kajimoto, Hiroshima, all of Japan

[73] Assignee: Director-General Seiichi Ishizaka of the Agency of Industrial Science and Technology, Tokyo, Japan

[21] Appl. No.: 38,121

[22] Filed: May 11, 1979

[30] Foreign Application Priority Data

Feb. 8, 1978 [JP] Japan ..... 53-12286

[51] Int. Cl.[3] ..... C10J 1/00

[52] U.S. Cl. ..... 208/8 LE

[58] Field of Search ..... 208/8

[56] References Cited

U.S. PATENT DOCUMENTS 3,849,287 11/1974 Gleim et al. ..... 208/8 LE

*Primary Examiner*—Veronica O'Keefe

*Attorney, Agent, or Firm*—Holman & Stern

[57] ABSTRACT

A method of liquefying coal by reaction in a slurry mixture with a solvent consisting of an organic heavy fraction, with the application of heat, is characterized in that the slurry-based reactants are mixed with light aliphatic compounds to make use of the latent and sensible heats of the latter in lowering the reactant temperature, whereby the coal-liquefying reaction and thermal polycondensation reaction of the organic heavy fraction are controlled.

4 Claims, 3 Drawing Figures

METHOD FOR EFFECTING COAL-LIQUEFYING REACTION

This invention relates to improvements in a method for effecting coal-liquefying reaction.

Conventional processes for coal liquefaction are roughly divided into three groups; the reaction of coal with hydrogen in some way or other and subsequent distillation to obtain light fractions for conversion into oil; mixing of coal with a solvent and a reaction at elevated temperature with subsequent distillation to obtain light fractions; and complete gasification of coal and a repeated process for synthesis of light hydrocarbons.

The method provided in accordance with the present invention comes under the second group in which coal is slurried with a solvent for the reaction. For the practice of the process, the invention is concerned with a method of controlling the reaction conditions, especially the reaction time, so as to effectively improve the liquefiability of coal.

In the art of coal liquefaction the control of reaction conditions has not received very close attention. The control means so far employed are only flash drums, heat exchangers and the like which are used to lower the reactant temperatures. These methods and their drawbacks will be briefly described below.

(1) Flash drum method:

This method utilizes the heat of evaporation of the reactants themselves to decrease the reactant temperature until the reaction terminates. To attain the end, the reaction vessel calls for a high pressure before the termination of the reaction. Moreover, the reaction mixture in the form of a slurry of coal particles in a solvent is deprived of low-boiling light fractions by the flashing. Consequently, the effect of temperature drop is more than offset unfavorably by decreased fluidity of the slurry as a whole, which in turn hampers the transport of slurry within the process lines and makes difficult the separation of ash from coal, a step of vital importance in this type of process for coal liquefaction.

(2) Heat exchanger method:

This method involves no such loss of light reaction products as in the afore-described method (1), and therefore no decrease in the viscosity of the slurry as a whole results. However, the separability of ash is adversely affected by a decrease in fluidity with the temperature drop. Further, the installation of the heat exchanger causes other troubles, such as choking of the process lines with localized deposition and solidification of the reactants on the inner wall surfaces of the equipment.

The present invention aims at the provision of a control method which overcomes the foregoing difficulties. A more detailed description of the invention will be given with reference to the accompanying drawings, in which.

Figure 1:
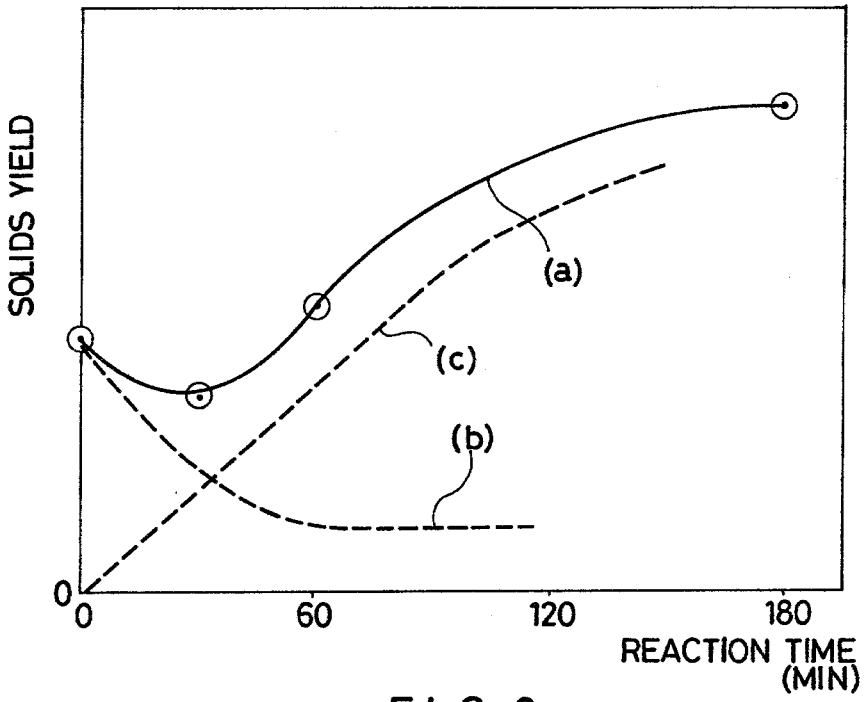
FIG. 1 is a graph showing the relationship between solids yield and time.

In the process for liquefaction of coal through slurrying of coal with an organic heavy fraction and a reaction of the resulting slurry with heat, the relationship between the coal liquefaction rate and the reaction time is as shown in FIG. 1. The graph summarizes the results of experiments conducted with the coal obtained from a mine at Miike, Japan, as the material coal and a vacuum residue from Iranian Heavy crude as the organic heavy fraction.

In FIG. 1 the full line a indicates actual solids yields and the broken line b indicates estimated changes in the residual coal amount with the coal-liquefying reaction. Another broken line c represents estimated changes in the partial conversion of the organic heavy fraction as the solvent into solids due to a thermal polycondensation reaction.

As will be appreciated from the relationship in FIG. 1, it is essential for effective coal liquefaction by reaction of coal with an organic heavy fraction to reduce the total solids yield to a minimum by maintaining the highest possible rate of liquefaction and minimizing the solids formation by the thermal polycondensation of the organic heavy fraction.

With the view to inhibiting the increase in the solids yield and improving the coal liquefaction rate, the present invention is directed to a method for coal-liquefying reaction whereby the reaction is carried out within the range of optimum conditions shown in FIG. 1.

For the attainment of a reaction-retarding effect comparable to those by the flash drum and heat exchanger methods and for a remarkable improvement in the solids separability which is low in the both methods, the invention provides a method for effecting a temperature drop to "freeze" the objectionable reaction, which comprises mixing an oily matter rich in aliphatic compounds with the reaction products and lowering the reaction temperature by taking advantage of the latent and sensible heats of the oily matter. The oily matter to be used for the reaction freezing in accordance with the invention serves also as a solvent for the reactants and is able to prevent an increase in viscosity due to the temperature drop. Like the distillate produced by the reaction, the oily matter is rich in aliphatic compounds and behaves as a poor solvent to the reaction products, particularly the solid matter formed by agglomerating of ash out of coal. It thus advantageously facilitates the process of separating solids from other reaction products.

The organic heavy fraction for use in the present invention may well be what is customarily used in the second method of said prior art. For instance, it may be a residue of vacuum distillation of petroleum and a mixture of residue of vacuum distillation of petroleum and coal tar pitch.

So far as such residue of vacuum distillation of petroleum is concerned, a difference in the place of its origin or manufacturing conditions will never come into question excluding certain particular material such as a residue of Minas crude oil (Indonesia). Namely, it may be a residue of vacuum distillation of petroleum which is obtained by mixing crude oils of different places of origin or such residue deasphalted by the propane deasphalting process.

Likewise, so far as coal for use in the present invention is concerned, the kind of its place of origin will not come into question, either.

As oil parts rich in compounds of fatty acid, it is possible to use light oil of petroleum (for example, b.p. 190°-350° C., the number of carbon atoms, 11-22), light oil as a reaction product of the present invention (b.p. less than 200° C.), medium oil (b.p. 200°-360° C.) and heavy oil (b.p. 360°-530° C.). There are some cases where a residue of vacuum distillation of petroleum for use as the raw material in the present invention may be used as the aforesaid oil part.

Figure 2:
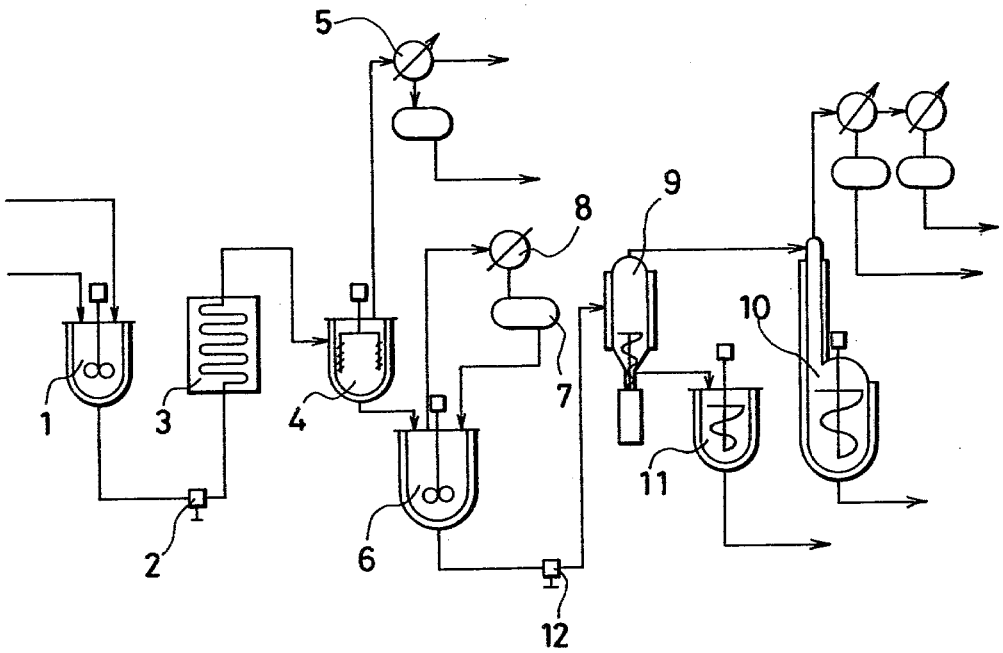
FIGS. 2 and 3 are flow sheets of embodiments of the invention.

The invention will now be described with reference to FIG. 2 showing a first embodiment for practice of the invention.

Coal ground in advance to a particle size, e.g., from 75μ (2000 mesh) to 840μ (20 mesh) and a heavy fraction solvent, e.g., a residue of vacuum distillation of petroleum, are mixed in a slurrying tank 1. The resulting slurry is sent by a pump 2 to a heater 3, where it is heated to a predetermined reaction temperature between 390° and 430° C. for supply to a reaction vessel 4. In the vessel 4 the slurry is kept with stirring, e.g., at a normal pressure and at a reaction temperature of 410° C. for from 20 to 30 minutes. Gases, light gas oil fractions, etc. that evolve from the reactants kept under the predetermined reaction conditions are conducted from the reaction vessel 4 to a cooler 5 for disposal. The slurry left as the reaction products in the vessel 4 is then transferred to a reaction freezer 6.

In the reaction freezer 6 the slurry of reaction product is mixed with a light fraction solvent, e.g., a middle gas oil fraction (b.p. 200°–360° C.) or heavy gas oil fraction (b.p. 360°–530° C.) produced in the process, which is supplied from a reaction-freezing-agent storage tank 7. By the latent and sensible heats of part of the solvent, the reactant temperature is adjusted to 370° C. or downwards at which the progress of the thermal polycondensation reaction is negligible. The gases and light gas oils produced in the reaction freezer 6 are recovered by a cooler 8 for reuse.

In this way the reaction products are allowed to contain part of the light fraction solvent as a reaction freezing agent. The reaction products are then transferred from the reaction freezer 6 by a pump 12 to a solid-liquid separator 9 for separation into a phase free of solids and a solids-containing phase. The solids-free phase is sent to a distillation unit 10, where it is separated into end products, i.e., middle and heavy gas oil fractions and ashless pitch. The solids-containing phase is adjusted in properties in a solidification tank 11 to give a solid product.

Next, an experiment on actual coal liquefaction conducted with another embodiment illustrated in FIG. 2 will be described.

In this example of experiment, as a coal, Miike coal which have a property as shown Table-1 is used. As a residue of vacuum distillation of petroleum, the residue of vacuum distillation of Iranian heavy crude oil as shown Table-2 is used.

TABLE - 1:

| | | |
|---|---|---|
| Technical analysis (wt %) | ash | 11.0 |
| | V M | 42.2 |
| Elemental* analysis (wt %) | C | 82.8 |
| | H | 6.2 |
| | N | 1.0 |
| | S | 2.30 |
| | residue | 7.7 |
| Composition analysis (%) | All reactives | 96.6 |
| | Inerts | 3.4 |
| Crucible Swelling Number (CSN) | | 7 |

*Elemental analysis is based on d.a.f. base.

TABLE - 2:

| | | |
|---|---|---|
| Rate of penetration | @25° C. | 73 |
| Flexibility point | (R&B)°C. | 48.5 |
| Specific gravity | (25/25°C.) | 1.0204 |

TABLE - 2:-continued

| | | |
|---|---|---|
| Viscosity | @120° C. cst | 662.0 |
| | @180° C. cst | 63.0 |
| Composition Analysis (wt %) | Saturated compounds | 22 |
| | Aromatic compounds | 44 |
| | Resin | 24 |
| | Asphaltene | 10 |
| Elementary Analysis (wt % d.a.f. base) | C | 84.6 |
| | H | 10.6 |
| | N | 0.9 |
| | S | 3.7 |

One part by volume of Miike coal ground to a size, e.g., within a range of 20–200 mesh, and two parts by volume of the vacuum residue of Iranian Heavy crude were allowed to react under the reaction conditions that would give a minimum of solids yield in FIG. 1, e.g., at 405° C. for 30 min. Following this run of reaction, the resultants were mixed, at the rate of 0.01–0.5 parts by weight, preferably 0.05–0.2 parts by weight per 100 parts by weight of the resultants, with a mixture of light gas oil compounds as a reaction freezing agent, e.g., light gas oil of petroleum or light, middle, or heavy gas oil fraction of the reaction products, and the reaction temperature was kept below 360° C., preferably in the range from 300° to 350° C. This procedure inhibited the excess production of organic solids, including the mesophase, which would otherwise result from a thermal polycondensation reaction of the soluble matter of Miike coal, vacuum residue of Iranian Heavy crude, or from the liquid reaction product.

Ordinarily, with the progress of reaction, the slurry tends to undergo changes in its viscosity characteristic due to aromatization and become hard to handle for transport, separation, etc. The addition of the light reaction freezing agent in accordance with the invention makes up for the loss of fluidity due to increased viscosity of the slurry on the temperature drop and thereby provides ease of handling within the process lines.

With the heat treatment process of this character in which the coal-liquefying reaction is effected using an organic heavy fraction, especially residual oil of petroleum, as the solvent, it is often the case that coking or objectionable buildup of coke or carbon deposits in the reaction vessel and heater, leads to choking and other troubles. This has been a major hindrance to the commercial acceptance of the process. The second embodiment of the invention which precludes this coking will be described below with reference to FIG. 3.

Figure 3:
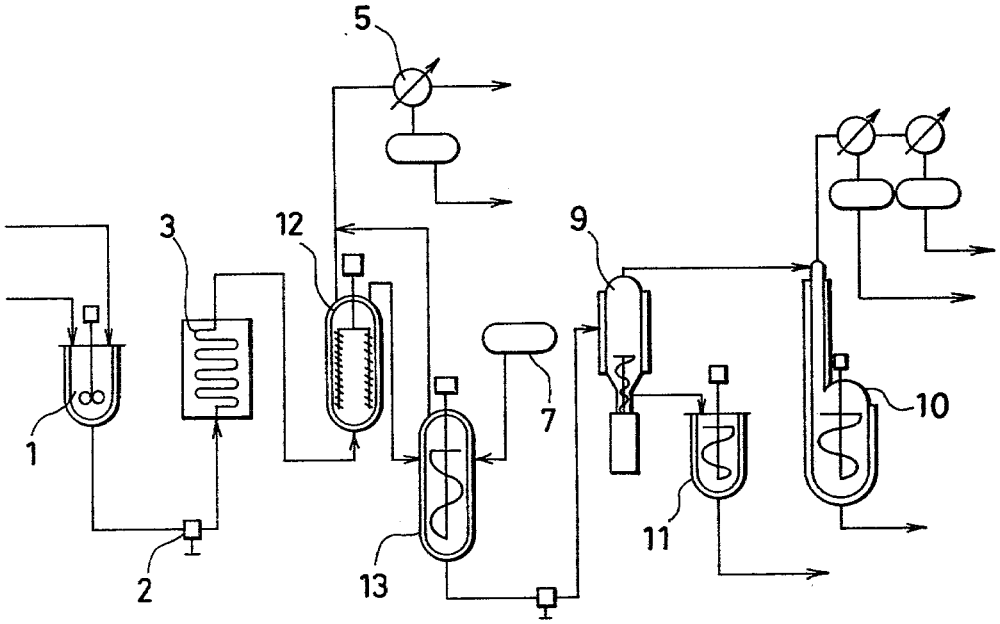

In FIG. 3, coal and a solvent, e.g., a vacuum residue of petroleum, are mixed in a slurrying tank 1, and the resulting slurry is heated in a heater 3 to a predetermined reaction temperature, e.g., between 390° and 430° C. Next, the hot slurry is fed to a reaction vessel 12 at the bottom, kept therein for a necessary period of time for reaction, e.g., from zero to 120 minutes, and is conducted from the top of the vessel 12 into a reaction freezer 13. In the latter vessel the reactants are mixed with a light fraction solvent, e.g., a middle gas oil fraction (b.p. 200°–360° C.) or heavy gas oil fraction (b.p. 360°–530° C.) produced in the process or a vacuum residue of crude oil, and the reaction temperature is lowered to 390° C. or under, when a gas-liquid interface is for the first time formed within the vessel. Following this, the gases and distillate fractions forming part of the reaction products and freezing agent are separated and recovered through the cooler 5. The rest is sent, for example, to the solid-liquid separator 9 for separation into the phase containing or not containing solids for subsequent treatments as already described in connection with the first embodiment.

A practical experiment conducted with this process will now be explained.

Generally it is well-known that processes of this character in which organic compounds are allowed to react at high temperatures of over 400° C. are accompanied by the formation of solid organic substances called the mesophase. Where the reactants at such elevated temperature form a gas-liquid interface, the reactants clinging to the inner wall of the vessel along the interface will not flow away. Consequently, that portion will experience a longer and severer heat hysteresis bysteresis than the rest and the reactant deposits there undergo rapid thermal polycondensation with the possibility of coking.

Whereas the coal liquefaction in conformity with the invention requires a reaction temperature of over 390° C., desirably between 400° and 450° C., this temperature range is also one in which the above-mentioned coking is likely to occur. In view of this, the reaction vessel 12 in FIG. 3, designed for the temperature conditions necessary for the coal liquefaction, was of a filled-up type which would not form the gas-liquid interface that tends to cause coking. The charge in the reaction freezer 13 was mixed with a light fraction solvent in accordance with the invention, and the temperature was decreased to or below 390° C. at which the coking trouble was practically negligible, and then a gas-liquid interface was allowed to develop. Thus, gases and distillate fractions were separated and obtained as final reaction products, precluding the coking trouble that has presented the greatest difficulty in this type of operations.

What is claimed is:

1. A method of liquefying coal by reaction in a slurry with a solvent comprising mixing coal with a first solvent of a residue of vacuum distillation of petroleum to form a slurry, heating said slurry to a reaction temperature between 390° C. and 430° C. to produce a reaction product slurry and mixing said reaction product slurry with a second solvent rich in aliphatic compounds to adjust the slurry temperature to 370° C. or below to control the coal-liquefying reaction and the thermal polycondensation reaction of said first solvent.

2. A method of liquefying coal as claimed in claim 1, wherein said mixing coal with a first solvent of a residue vacuum distillation of petroleum is done in a slurry tank, said slurry is passed to a heater for heating said slurry to between 390° C. and 430° C., passing said heated slurry to a reaction vessel, said reaction product slurry being produced in said reaction vessel, passing said reaction product slurry to a reaction freezing vessel, said second solvent is added to said freezing vessel for mixing with said reaction product slurry, passing the reaction product slurry to a solid liquid separator and separating it into solid and liquid phases.

3. A method according to claim 1 or 2, characterized in that said second solvent is mixed with said reaction product slurry at a rate of 0.01–0.5 parts by weight per 100 parts by weight of the reaction product slurry.

4. A method according to claim 1 or 2, characterized in that said slurry is kept at from 390° to 430° C. with stirring in said reaction for from 20 to 40 minutes and said reaction product slurry is mixed with 0.5–0.2 parts by weight of said second solvent per 100 parts by weight of said reaction product slurry.

* * * * *